US005791028A

United States Patent [19]

Zolin

[11] Patent Number: 5,791,028

[45] Date of Patent: Aug. 11, 1998

[54] RECIPROCATING HYDROENHANCEMENT SYSTEM

[75] Inventor: Paul F. Zolin, Kennebunk, Me.

[73] Assignee: Valmet Inc., Biddeford, Me.

[21] Appl. No.: 922,413

[22] Filed: Sep. 3, 1997

[51] Int. Cl.[6] ..... D06C 29/00; D04H 1/46

[52] U.S. Cl. ..... 26/1; 28/104; 28/106

[58] Field of Search ..... 28/103, 104, 105, 28/106, 107, 114; 8/147, 148, 149, 149.1, 149.2, 150, 151, 151.1; 68/180, 176, 201, 200, 203; 26/1

[56] References Cited

U.S. PATENT DOCUMENTS

| | | | |
|---|---|---|---|
| 4,130,689 | 12/1978 | Costa, Jr. | 428/398 |
| 4,132,592 | 1/1979 | Brandon et al. | 162/216 |
| 4,166,877 | 9/1979 | Brandon et al. | 428/221 |
| 4,174,237 | 11/1979 | Hemming, Jr. et al. | 156/64 |
| 4,960,630 | 10/1990 | Greenway et al. | 428/131 |
| 4,995,151 | 2/1991 | Siegel et al. | 26/69 |
| 5,142,752 | 9/1992 | Greenway et al. | 28/105 |
| 5,281,441 | 1/1994 | Kasai et al. | 28/104 |
| 5,311,389 | 5/1994 | Howey | 360/133 |
| 5,630,261 | 5/1997 | Beasley et al. | 28/104 |
| 5,657,520 | 8/1997 | Greenway et al. | 28/104 |

*Primary Examiner*—C. D. Crowder
*Assistant Examiner*—Larry D. Worrell, Jr.
*Attorney, Agent, or Firm*—Joseph W. Molasky & Associates

[57] ABSTRACT

A technique and apparatus for providing reciprocating hydroenhancement includes a pair of fabric spools with a hydroenhancement process disposed therebetween. The hydroenhancement process is configured to impart a minimal amount of hydroenhancement to the fabric passing therethrough and may comprise only a single vacuum roll and associated single hydroenhancement jet (other arrangements may use two or three of vacuum rolls and jets in order to provide controllable "front side" and "back side" treatments on a per pass basis). The fabric to be treated is loaded onto a first spool, passes through the hydroenhancement process and is thereafter taken up on the second spool. Once the entire length of fabric has been treated and loaded onto the second spool the process is reversed; the fabric is unwound from the second spool, treated a second time and re-loaded onto the first spool. The process is reversed once again, and a second "forward" treatment is imparted to the fabric. This "back and forth" (i.e., "reciprocating") hydroenhancement process is continued until the desired degree of hydroenhancement has been achieved. Measuring units (such as a permeability measuring system) may be used to evaluate the hydroenhancement on each pass to control various process parameters, as well as to determine when to stop the process.

56 Claims, 5 Drawing Sheets

RECIPROCATING HYDROENHANCEMENT SYSTEM

BACKGROUND OF THE INVENTION

1. Field of the Invention

The present invention relates to a reciprocating hydroenhancement system and, more particularly, to a hydroenhancement apparatus and method with improved efficiency and increased flexibility in textile finishing capability, while also providing a reduction in size when compared with standard hydroenhancement systems.

2. Description of the Prior Art

In conventional hydroentangling processes, webs of nonwoven fibers are treated with high pressure fluids while supported on an "entangling" substrate wire. Typically, the substrate wire is provided on a drum or continuous planar conveyor which traverses a series of pressurized fluid jets to entangle the web into cohesive ordered fiber groups and configurations corresponding to open areas in the screen. Entanglement is effected by the action of the series of fluid jets that causes the individual fibers in the web to migrate to open areas in the screen, tangle and intertwine.

Hydroenhancement is a term used to describe the hydroentanglement process when used specifically on a woven fabric. In hydroenhancement, the properties of a woven fabric are modified (or "enhanced") by exposing the fabric to a sequence of high pressure water jets to act on the woven, spun thread fibers that make up the fabric. During the enhancement process, fibers from the same or adjacent threads become entangled, thus changing the fabric's properties (usually resulting in decreasing the open spaces among the weft and warp threads).

In a conventional continuous process hydroenhancement system, a relatively large number of pressurized water jets are required to provide the requisite amount of hydroenhancement in a single pass. For example, it would not be unusual for a hydroenhancement system to require from six to as many as 20 separate pressurized water jets to achieve the desired degree of hydroenhancement. As a consequence, the number of "active" jets, the associated water pressure and the line speed must often be modified for the different fabrics that are passed through the system. In general, it can be presumed that an exemplary hydroenhancement system is designed so as to be capable of providing the "maximum" degree of hydroenhancement in a single pass, and the system must then be "backed down" (by, for example, turning "off" one or more jets, reducing the line speed, or reducing the pressure of the water stream exiting the jets) during any situation where a lesser degree of hydroenhancement is required.

Limitations associated with the prior art arrangements include the extensive floor space required to form a hydroenhancement process line sufficient to achieve the "maximum" hydroenhancement value described above. Further, if any fabric requires a degree of enhancement beyond the original equipment design, the entire production line will require modification (that is, more jets will need to be added) or the fabric will need to be completely reprocessed (that is, put through the complete hydroenhancement line a second time). Additionally, the maximum nature of the system is an "overbuild" for many applications, either those of small runs of material or applications where a minimal degree of hydroenhancement is required. In these situations, the overall efficiency of the process (as compared with the size of the process line) is extremely low. Lastly, the continuous nature of conventional hydroenhancement systems is problematic when developing new hydroenhanced fabrics, since the ability to "test" the degree of hydroenhancement required to impart to any given fabric is virtually non-existent.

Therefore, a need remains in the art for a more robust hydroenhancement process that will impart essentially the proper degree of hydroenhancement to woven materials, while also being more efficient and economical to utilize.

SUMMARY OF THE INVENTION

The present invention relates to a reciprocating hydroenhancement process that utilizes a minimal number of pressurized jets disposed between a pair of tension-controlled reciprocating spools. In accordance with the present invention, either or both spools may be replaced by a tension-controlled A-frame or any suitable means for support the fabric, where the A-frame structure is generally used in the industry to transport the fabric during processing. The fabric is loaded onto the first spool, passed under the hydroenhancing jet or jets and taken up on the second spool (this defines a first, or forward, "pass" through the system). Once the complete length of fabric has been wound onto the second spool, the process is reversed—that is, the fabric is unwound off of the second spool, passed under the hydroenhancement jet(s) and taken up on the first spool (defining a second, or reverse, "pass" through the system). This "reciprocal" process is then repeated back and forth until the requisite degree of hydroenhancement is achieved. Thus, the fabric is contained within the hydroenhancement system until the proper degree of hydroenhancement is achieved.

In one embodiment of the invention, the hydroenhancement of the fabric may be measured, using a process such as that disclosed in my copending application Ser. No. 08/922,412, filed Sep. 3, 1997 and used as a control signal to stop the hydroenhancement process when the proper degree of hydroenhancement (as indicated by, for example, a predetermined decrease in fabric permeability) is achieved. Additionally, the reciprocal nature of the present invention allows for the degree of hydroenhancement to be modified on a "per pass" basis. Therefore, various process parameters including, but not limited to, line speed, fabric tension, number and location (defined as the "identity") of the active jets in the set of hydroenhancement jets, and hydroenhancement energy (defined by the pressure of the liquid exiting the hydroenhancement jets) can be modified on each pass to provide any desired hydroenhancement result in the final product.

It is an aspect of the present invention that the spools and jets may be configured such that "front side" (F) and "back side" (B) hydroenhancement may be performed in any desired pattern. For example, a front treatment and a back treatment may be performed on each forward pass (an FB sequence) and reverse pass (a BF sequence), resulting in a series of passes characterized as FB-BF-FB-BF-FB, that may be repeated until the requisite degree of hydroenhancement is achieved. Alternatively, a front side treatment may be performed on each "forward" pass and a back side treatment on each "reverse" pass—referred to as an "alternating pass" system (i.e., F-B-F-B-F-B..). In general, any combination is possible and is considered to fall within the scope of the present invention. Advantageously, any suitable number of passes through the apparatus may be performed.

Additionally, as compared with conventional hydroenhancement arrangements, the apparatus of the present invention requires minimal floor space—only the space necessary for a pair of spools and a limited number of hydroenhancement jets and associated equipment. Indeed, an exemplary reciprocating hydroenhancement system may include only a single jet and associated fabric support system (e.g., vacuum roll or moving wire system); a system to perform both "front side" and "back side" hydroenhancement may be formed using only two or three jets (each jet having its own fabric support system), depending upon how the jets are controlled.

It is an advantage of the efficiency of the reciprocating hydroenhancement arrangement that additional processes may be performed simultaneously with the hydroenhancement process (that is, without moving the fabric to another machine). For example, an acid bath (or any suitable "pre-treatment" and/or "post-treatment" processes) may be added prior to, afterward, or simultaneously within a hydroenhancement unit, allowing two or more separate finishing processes to be accomplished essentially simultaneously, thereby improving the overall efficiency of the production line with reduced product handling.

It is to be understood that the reciprocating process to be described in detail hereinbelow may also be used, in certain circumstances, to provide hydroentanglement on non-woven materials. In such instances, the non-woven material requires a sufficient strength so as to withstand the "back and forth" nature of the reciprocating process without stretching or tearing. Other and further features and aspects of the present invention will become apparent during the course of the following discussion and by reference to the accompanying drawings.

BRIEF DESCRIPTION OF THE DRAWINGS

Referring now to the drawings.

DETAILED DESCRIPTION OF THE PREFERRED EMBODIMENT

Figure 1:
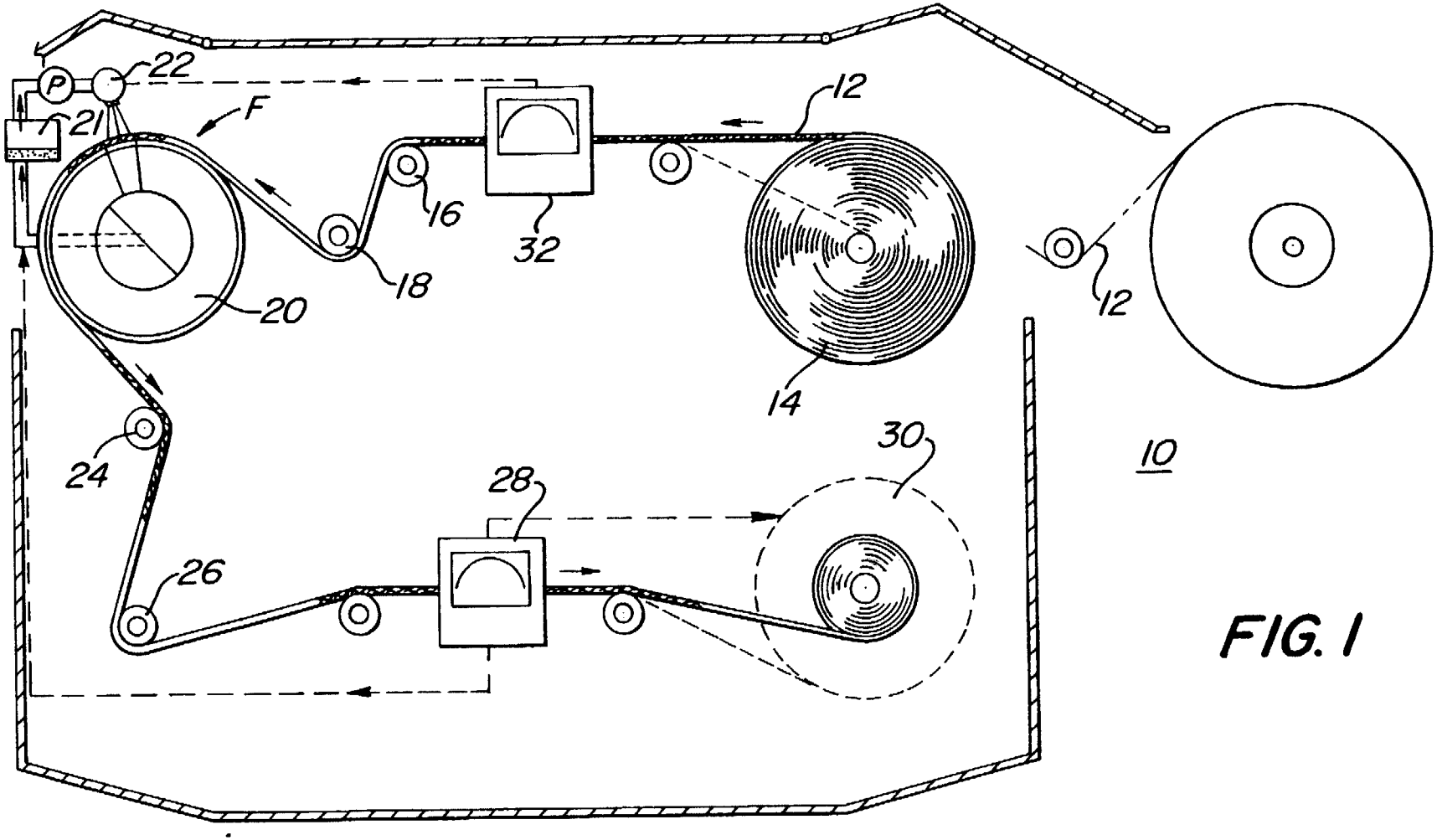
FIG. 1 illustrates an exemplary reciprocating hydroenhancement arrangement of the present invention utilizing a single pressurized jet.

FIG. 1 illustrates a relatively simple reciprocating hydroenhancement system in accordance with the present invention. System 10 receives the woven fabric 12 from a main roll, where fabric 12 is initially loaded onto a first spool 14 so that the entire length of fabric to be subjected to hydroenhancement has been loaded onto first spool 14. Alternatively, first spool 14 may simply comprise a portable main roll (such as an "A" frame) that can be subsequently be used to transfer the hydroenhanced product to another process. First spool 14 may include a permanent or semi-permanent "clamping leader" to provide a means for attaching fabric 12 to first spool 14, where the leader is of a sufficient length to accommodate the complete enhancement of the fabric. Preferably, the clamping leader is formed of a metal wire screen that is non-absorbent with respect to dye stuff. The utilization of such a material as the clamping leader allows for the leader to be re-used as each new spool of fabric is loaded. Fabric 12 then passes through a pair of tension adjusting devices 16, 18 (that cooperate with spools 14 and 30 to control the line speed and fabric tension during hydroenhancement) and thereafter passes over a vacuum roll 20. Instead of requiring separate tension-adjusting devices, spools 14 and 30 may be configured to directly sense and control tension. A hydroenhancement jet 22 is associated with vacuum roll 20 and is used to impart a predetermined amount of hydroenhancement to the front side F of fabric 12. For example, a jet 22 may emit of stream of liquid (e.g., water) at a predetermined psi value (any value between, for example 50 psi and 6000 psi may be used) onto the front side F of fabric 12. Various other liquids may be used. A recirculating liquid system 23 may be used in conjunction with jet 22 and vacuum roll 20 to provide a liquid (in this case, water) supply for the hydroenhancement process. In general, water system 23 includes a pressurization module to create the predetermined psi mentioned above. Further, system 23 functions to filter the return water exiting from vacuum roll 20. The filtration functions to separate any fibers from the water before allowing for the water to enter the pressurization module. If a dye is included in the water, the filtration system must be capable of removing the filters without the dye stuff from the water. Such filtration systems and are conventional and well-known in the art. A vacuum source would also be included in system 23 to effect the movement of water out of vacuum roll 20 and back into system 23. Jet 22 may be disposed in a fixed relationship with respect to vacuum roll 20. Alternatively, jet 22 may be allowed to vibrate or slightly oscillate with respect to roll 20, where this motion of jet 22 is known to minimize or prevent any unwarranted pattern on the surface of the fabric being processed.

Referring to FIG. 1, once an exposed section of fabric 12 has been subjected to the hydroenhancement treatment it will pass through another pair of tension controllers 24,26 and enter a hydroenhancement measure unit 28. Generally speaking, hydroenhancement measurement unit 28 is any apparatus suitable for evaluating, in real time, the degree of hydroenhancement imparted to fabric 12. For example, the permeability of fabric 12 is an indicator of the degree of hydroenhancement achieved and, therefore, a permeability measurement may be used to control the reciprocating hydroenhancement process. The control may be simply to stop the hydroenhancement process once the proper degree of hydroenhancement has been achieved. Additionally, the evaluation performed by measurement unit 28 may be used, as described above and indicated by the dashed lines in the Figures, to control, on a "per pass" basis, one or more or the process parameters associated with the hydroenhancement process. For example, the line speed, fabric tension, hydroenhancement energy (i.e., the pressure of the liquid exiting the hydroenhancement jet), or jet "on"/"off" sequence may all be controlled (either manually or automatically) to impart any desired type of hydroenhancement to the finished product. Advantageously, the reciprocating nature of the present invention allows for such modifications to conceivably be performed on any pass through the system. Prior art single pass systems had no capacity to perform any such "real time" modifications to the fabric being processed. An exemplary hydroenhancement measurement unit and control system is disclosed in my copending application Ser. No. 08/922,412, filed Sep. 3, 1997, which is hereby incorporated by reference.

Upon exiting measurement unit 28, fabric 12 is taken up on a second spool 30. Like first spool 14, second spool 30 may also include a permanent or semi-permanent "leader" to provide a means for attaching the end of fabric 12 to second spool 30 to provide the fabric with enhancement coverage along its entire length. The utilization of the leader sections on either end of fabric 12 allows for the full length of the product to be subjected to the hydroenhancement process.

The speed at which fabric 12 passes through system 10, as well as the tension of the fabric, must be carefully controlled so that a uniform degree of hydroenhancement is imparted to the entire length of fabric 12. Therefore, first and second spools 14 and 30 are equipped with proper drive motors and monitoring equipment (not shown) that are utilized to continuously monitor the system line speed and tension, and to adjust the "winding/unwinding" rates of the spools accordingly. As discussed above, the line speed and/or tension may be intentionally modified on any "pass" through the system to impart a desired quality to the processed fabric. Any such modification would only occur in a time interval between passes such that the process parameters do remain fixed as the entire length of fabric is processed on any particular pass.

Once the entire length of fabric 12 has been passed through system 10 and taken up onto second spool 30, the system is reversed and the fabric passes in the opposite direction, as indicated by the dotted arrows, through measurement unit 28, controllers 26 and 24, and thereafter is again subjected to hydroenhancement under pressurized jet 22 associated with vacuum roll 20. The degree of hydroenhancement added to fabric 12 during this reverse process may be measured in a second hydroenhancement unit 32 (including similar process parameter control capabilities, as indicated by the dashed lines). As with the forward process, the reverse hydroenhancement continues until all of the fabric has again been rewound onto first spool 14. Depending upon the hydroenhancement reading from measurement unit 32, the process may again be repeated, or stopped if sufficient hydroenhancement has been achieved.

Advantageously, the "back and forth" nature of the reciprocating hydroenhancement process allows for the fabric to be processed as many times as necessary to achieve exactly the desired degree of hydroenhancement. Therefore, instead of the conventional prior art single pass hydroenhancement system that may require, for example, 6 to 20 separate jets (and the floor space and water system support capacity associated with such a large number of jets), the reciprocating arrangement of the present invention may utilize as little as one jet per pass and perform 20 passes (or more or less, as desired) to achieve essentially the same degree of hydroenhancement as the conventional single pass system. The ability to monitor the hydroenhancement on a "per pass" basis is extremely useful during the processing of new fabrics, where the exact energy and line speed requirements may be unknown. In the prior art, the fabric would have to pass through the entire system and thereafter analyzed to see if too little or too much hydroenhancement had been performed. Obviously, there would be waste of fabric associated with such experimentation. In contrast, the reciprocating system of the present invention allows for the product to be inspected on each pass so that "over-enhancement" or inefficient processing does not occur. Further, the reciprocating nature of the process allows for the fabric tension to be well-controlled, since the settings for tension adjusting devices 16,18 and 24,26 may be monitored and re-set on each pass through the system. In particular, the devices may be reset to maintain a constant fabric tension on each pass or, alternatively, intentionally increase or decrease the fabric tension to provide for a special effect in the finished product.

Figure 2:
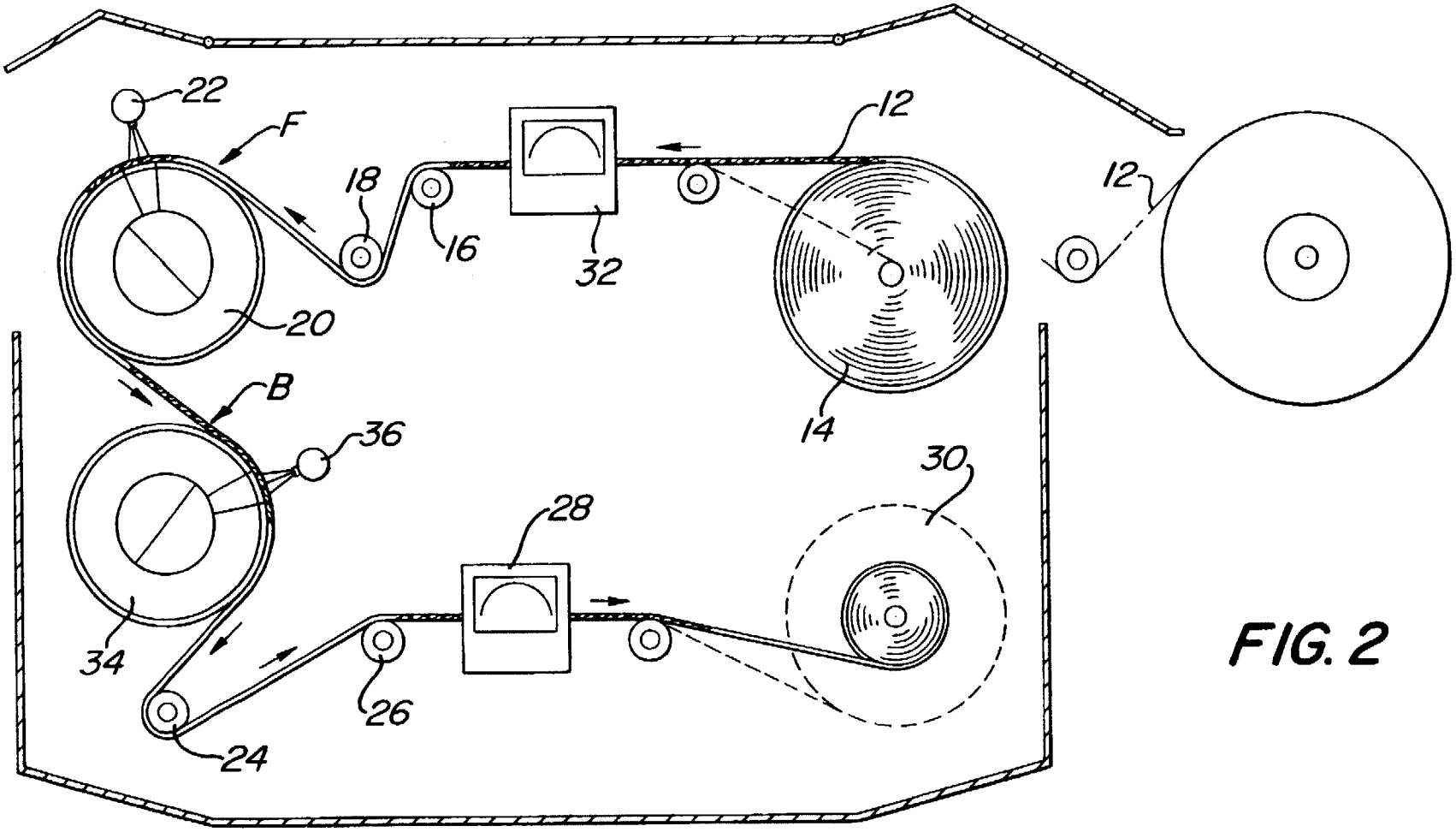
FIG. 2 illustrates an alternative embodiment of the invention for providing both "front side" and "back side" hydroenhancement by utilizing a pair of pressurized jets.

As mentioned above, it may be desirous to perform hydroenhancement on both the "front" and the "back" of the fabric. A reciprocating hydroenhancement system capable of providing front and back treatment is shown in FIG. 2. This arrangement differs from that of FIG. 1 by the addition of a second vacuum roll 34 and associated pressurized jet 36. Vacuum roll 34 and jet 36 are disposed "downstream" of first vacuum roll 20 and jet 22 and positioned such that the "back" surface B of fabric 12 is exposed to the stream of water exiting jet 36, as shown in FIG. 2. Although not shown, a recirculating water system, similar to system 23 of FIG. 1 may be used in association with the vacuum rolls and jets of the arrangement of FIG. 2. Referring back to FIG. 2, the fabric exiting second vacuum roll 34 has been subjected to hydroenhancement from a pair of jets 22,36, performing the process on the front (F) and back (B) surfaces, respectively, of fabric 12. Fabric 12 is then passed through hydroenhancement measurement unit 28, as described above in association with FIG. 1, and wound onto second spool 30.

Once the entire length of fabric has been subjected to the "first pass" of hydroenhancement on both the front side F and back side B of the fabric (an "FB" sequence as defined above), and presuming a sufficient degree of hydroenhancement has not been achieved (as measured by unit 28), the system will operate in the reverse mode and fabric 12 will pass in the opposite direction, as indicated by the dashed arrows. Again, fabric 12 will receive both a front and back hydroenhancement treatment, first passing under second hydroenhancement jet 36 to receive a backside treatment and then passing under first hydroenhancement jet 22 to receive a front side treatment (a "BF" sequence as defined above), and ultimately re-winding onto first spool 14. The reciprocating process will continue with a series of "forward" and "back" passes of the fabric (i.e., FB-BF-FB-BF) until measurement unit 28 (or measurement unit 32, if applicable) indicates that the proper amount of hydroenhancement has been achieved.

Since the reciprocating process may be easily controlled (either manually by an operator or automatically by a computer), any desired process permutation can be included. For example, the system can be configured to perform both "front" and "back" hydroenhancement treatments (FB) on each "forward" pass (i.e., in the direction from first roll 14 to second roll 30) and only a "front" hydroenhancement (F) on each "reverse" pass (i.e., in the direction from second roll 30 to first roll 14). Alternatively, a "front" side treatment may be applied in the forward direction and a "back" side treatment in the reverse direction (F-B-F-B . . . ). The flexibility associated with the reciprocating system in terms of process variation is significantly greater than that possible with a conventional single pass system. For example, the process may be controlled by controlling the line speed—that is, performing a first set of reciprocating passes at one speed, then performing another set of passes at a second speed. In conventional, single pass processes, it was impossible to effectuate such a speed change. Similarly, fabric tension and/or hydroenhancement energy (i.e., the pressure of the liquid exiting the jet(s), measured in psi) may be controlled or modified on a "per pass" basis. Another unique capability of the reciprocating arrangement is that the particular side of the fabric being subjected to hydroenhancement can easily be controlled by turning "on" and "off" various ones of the jets, as will be discussed below. In a conventional single pass design, there exists no capability to "stop" the process and switch the side of the fabric exposed to the hydroenhancement, change the line speed, modify the tension, etc. The system variations are endless; exemplary variations will be discussed below with respect to FIG. 5.

Figure 3:
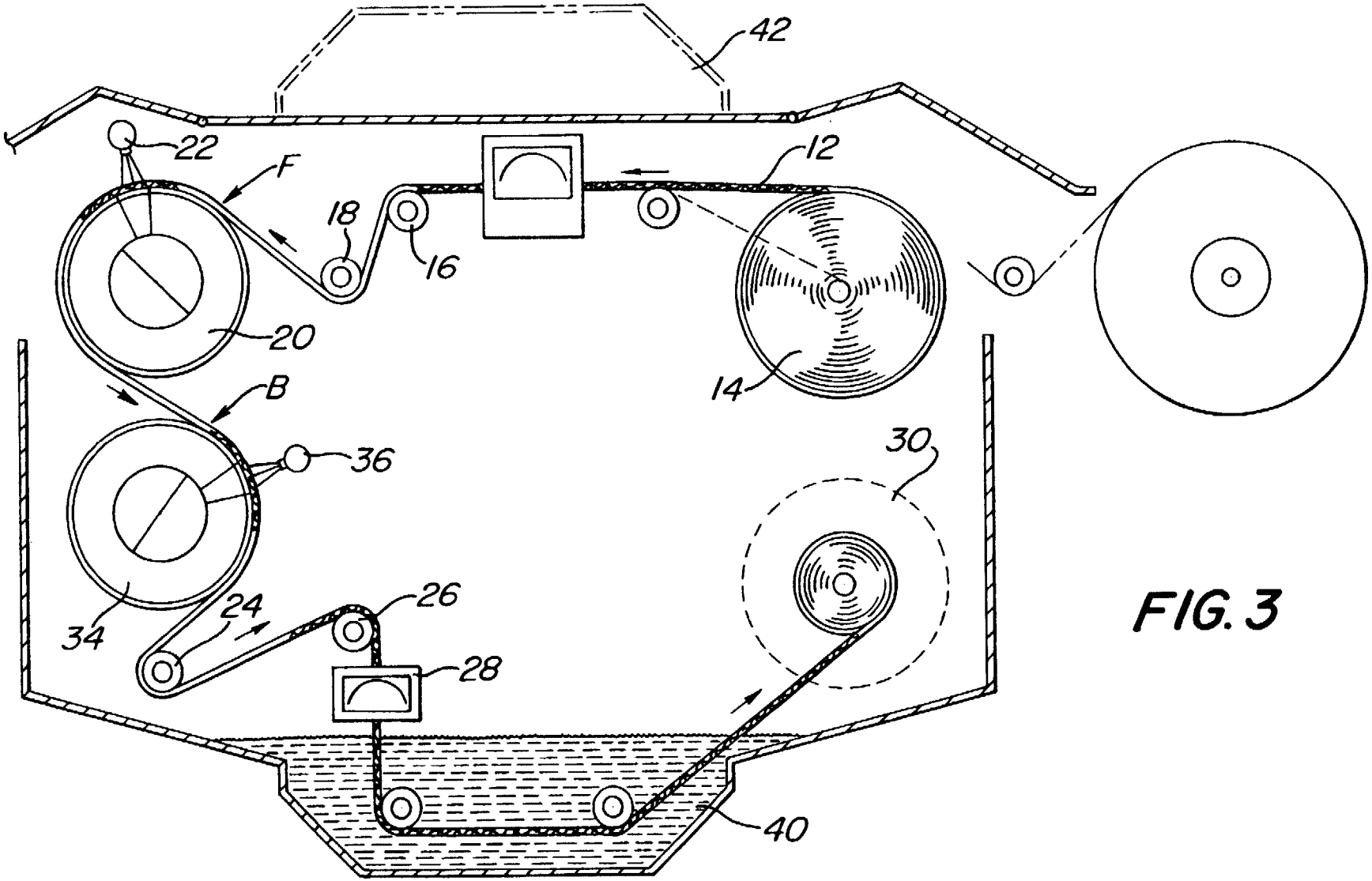
FIG. 3 illustrates a variation of the arrangement of FIG. 2, configured to include an additional processing step in series with the hydroenhancement process.

FIG. 3 illustrates an alternative embodiment of the present invention where an additional processing step has been added "in sequence" with the hydroenhancement process. Any desired finishing process, either a "pretreatment process" and/or "post-treatment" process may be included and increase the overall system efficiency by performing two (or more) operations essentially simultaneously. Referring to FIG. 3, an acid bath treatment zone 40 has been inserted between hydroenhancement measurement unit 28 and second roll 30. Other processes that may be inserted at zone 40 include, but are not limited to, dying, washing, bleaching or scouring of fabric 12. An additional zone 42, illustrated in phantom in FIG. 3, may be inserted between first roll 14 and measurement unit 32 (or first vacuum roll 20, as the case may be) and utilized to provide a "treatment" to fabric 12 (a non-liquid emersion treatment, for example, a UV light treatment, or spray additive, would be appropriate) before it enters the hydroenhancement process. In general, the system can be configured so that fabric 12 will pass through additional zones 40 and 42 on only a single pass through system 10 (and thereafter bypass these zones), or, alternatively, travel through these zones on each pass through the system. The choice is merely a matter of design and the type of additional processing being introduced.

Figure 4:
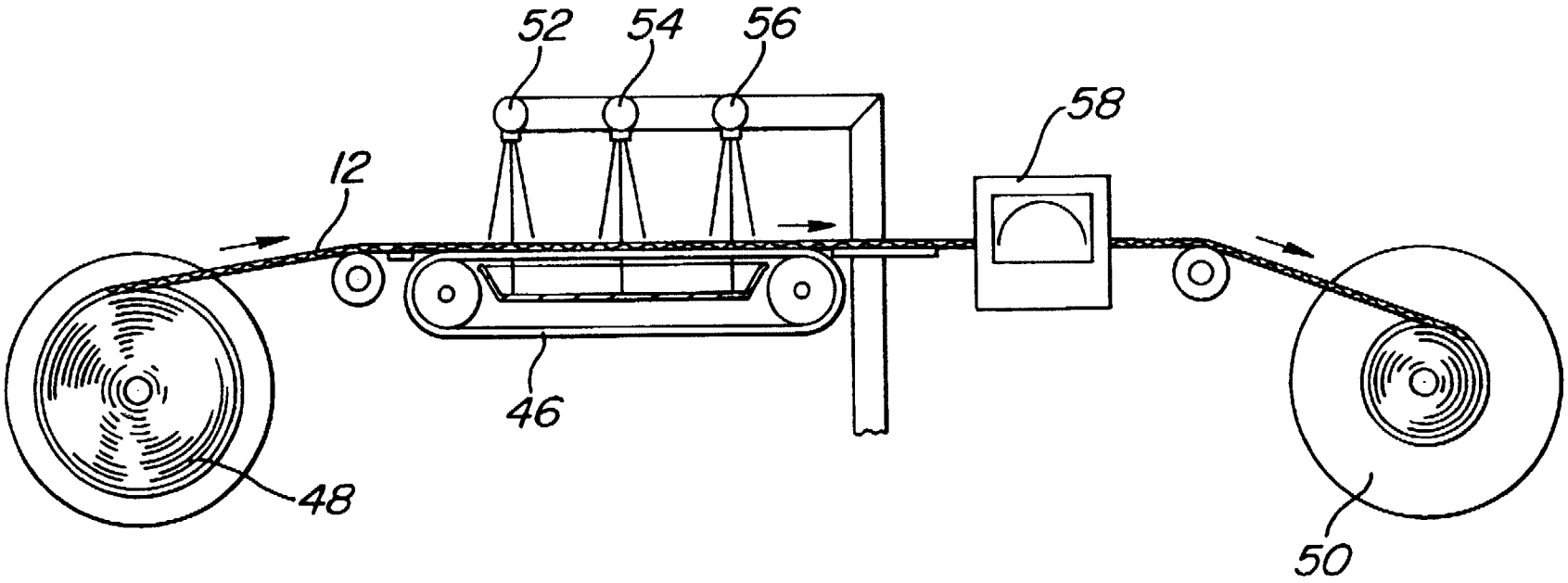
FIG. 4 illustrates another arrangement of the reciprocating hydroenhancement system, using a moving wire conveyor in place of the vacuum roll arrangement depicted in FIGS. 1–3, and formed to include a set of three pressurized hydroenhancement jets.

Each of the reciprocating hydroenhancement systems described thus far has utilized a combination of a vacuum roll and pressurized jet to provide the hydroenhancement treatment. There are various other arrangements capable of providing hydroenhancement that are viable alternatives for use in the reciprocating hydroenhancement system. In general, any arrangement that allows for a fabric to be exposed to a stream of liquid exiting a pressurized jet would suffice, any flat or curved surface, either permeable or non-permeable, with or without a vacuum, may be appropriate. FIG. 4, in particular, illustrates an exemplary hydroenhancement system that utilizes a moving wire conveyor arrangement 46, disposed between a first spool 48 and a second spool 50. As with the embodiments described thus far, fabric 12 is completely loaded onto first spool 48. The fabric then passes under the hydroenhancement jets. Three separate jets 52, 54 and 56 are shown in FIG. 4 and shown be considered as exemplary. As with the arrangements shown in FIGS. 1—3, the embodiment of FIG. 4 may include only a single jet, or a pair of jets. A hydroenhancement measuring unit 58 is illustrated as interposed between the final jet 56 and second spool 50. The degree of hydroenhancement imparted to fabric 12 is thus measured as the fabric is wound onto second spool 50. Once fabric 12 has been complete wound onto second spool 50, the process is reversed and the fabric is completely re-wound onto first spool 48. The reciprocating process will then continue until the desired degree of hydroenhancement has been achieved. It is to be understood that additional processing, such as that illustrated in FIG. 3, may also be incorporated into a reciprocating system as illustrated in FIG. 4.

Figure 5:
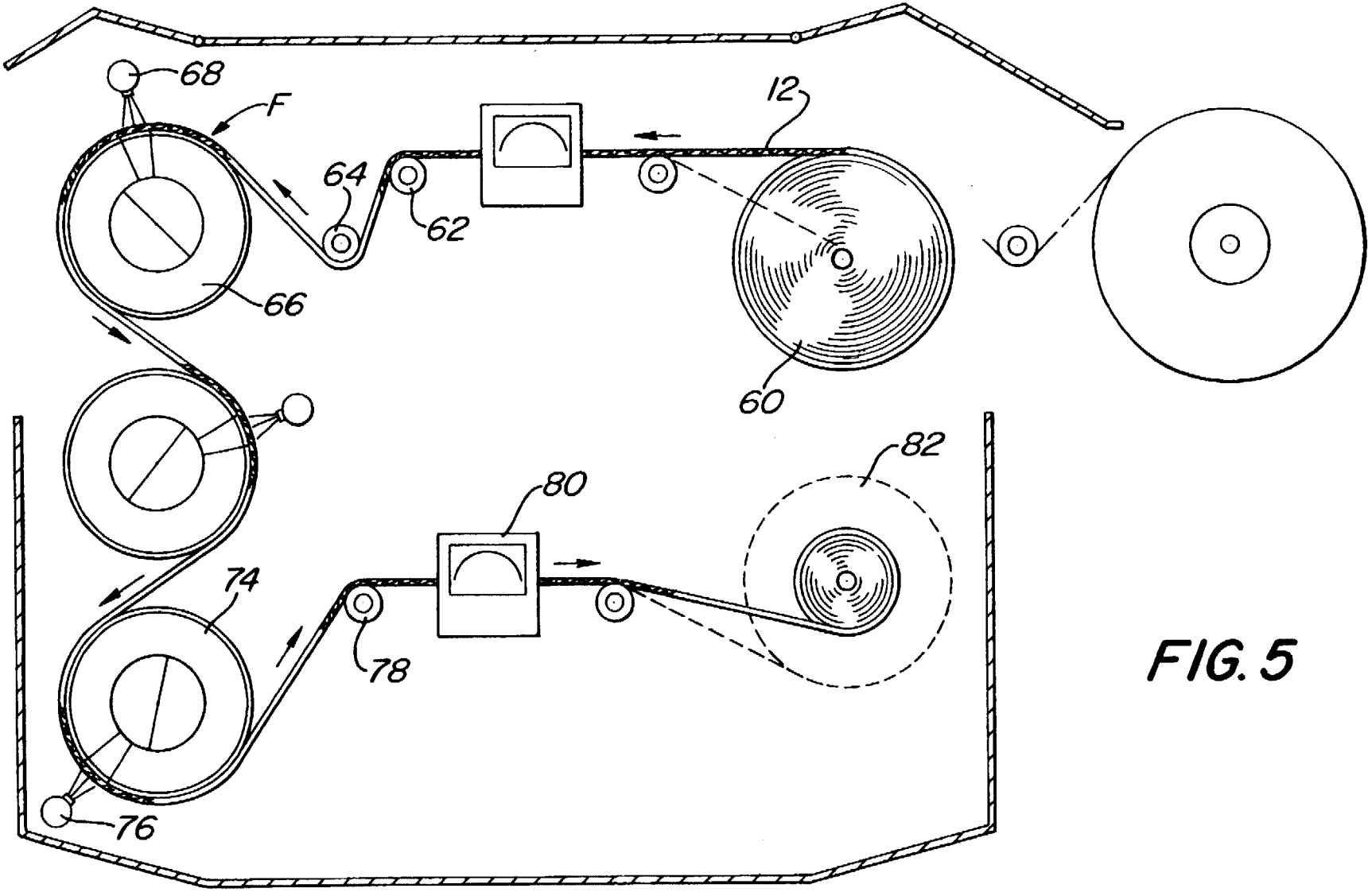
FIG. 5 contains an embodiment utilizing a set of three jets and associated vacuum rolls, where the three jets are controlled to provide any desired pattern of front-side and back-side processing.

As mentioned above, the utilization of a minimal number of jets in a reciprocating system allows for great flexibility in the hydroenhancement process. FIG. 5 illustrates another embodiment of the inventive reciprocating system, this arrangement utilizing vacuum rolls and including three separate hydroenhancement jets. As with the other embodiments, fabric 12 is first loaded onto a first spool 60. Fabric 12 thereafter is threaded through a pair of tension adjusters 62 and 64 and subsequently passes over a first vacuum roll 66. A first hydroenhancement jet 68 is positioned to provide a front side hydroenhancement treatment to fabric 12, as indicated by the letter "F" in FIG. 5. Thereafter, fabric 12 passes over a second vacuum roll 70, where a second hydroenhancement jet 72 is utilized to perform a back side treatment to fabric 12 (denoted by "B" in FIG. 5). Lastly, fabric 12 passes over a third vacuum roll 74, where a third hydroenhancement jet 76 is to be used for a front side treatment. Fabric 12 is then threaded through a second tension adjusters 78 and thereafter enters a hydroenhancement measurement unit 80. Fabric 12 is then taken up onto second spool 82 (it is to be understood that a permanent or semi-permanent leader may be used to attach fabric 12 between first spool 60 and second spool 82). In accordance with the teachings of the present invention, once the total length of fabric 12 has passed through the process has been completely loaded onto the second spool 82, the process is reversed and the fabric is subjected to hydroenhancement in the opposite direction, as indicated by the dotted lines, until the fabric has been completely re-loaded onto first spool 60. Any number of forward and reverse passes required to impart the desired degree of hydroenhancement may be used. The ability to control the three separate jets 68, 72 and 76 in combination with controlling the number of forward and reverse passes results in an extremely flexible system. For example, the arrangement of FIG. 5 could be controlled so that first jet 68 and second jet 72 are used in the forward direction (front/back treatment), with third jet 76 and second jet 72 used in the reverse direction (front/back treatment, thus providing the most efficient alternating side enhancement). Alternatively, jets 68 and 76 could be used in the forward direction (two front treatments for a "single side" enhancement), or only jet 72 used (back side only treatment).

Various other modifications and alternatives may be thought of and are considered to fall within the scope of the present invention. For example, although the above discussion has been directed to a reciprocating "hydroenhancement" process, the same reciprocating technique may also be utilized in certain "hydroentanglement" processes used with non-woven materials. In particular, non-woven materials that have been "strengthened" (for example, needled) may have sufficient integrity to allow a reciprocating hydroentanglement system to be used.

What is claimed is:

1. A hydroenhancement system including a first tension-controlled spool for containing a fabric to be processed;

hydroenhancement means coupled to receive fabric from the first spool for imparting a minimal degree of hydroenhancement to said fabric;

a second tension-controlled spool disposed to receive the fabric exiting said hydroenhancement means; and reversing means for sensing when the fabric has been completely wound onto said second spool and for changing the direction of the hydroenhancement process so that the fabric will pass through the hydroenhancement means in the reverse direction and be wound onto said first spool, and thereafter restarting the system in the forward direction so as to enable the system to operate in a reciprocating fashion for any desired number of passes through said hydroenhancement means.

2. A hydroenhancement system as defined in claim 1 wherein each end of the fabric is connected to a clamping leader of sufficient length to permit full travel of the fabric on each pass through the hydroenhancement means.

3. A hydroenhancement system as defined in claim 2 wherein each clamping leader comprises a metal wire screen that is non-absorbent with respect to dye stuff.

4. A hydroenhancement system as defined in claim 1 wherein the system includes a hydroenhancement measuring unit to measure the degree of hydroenhancement imparted to the fabric by the hydroenhancement means and control the reversing means so as to end the hydroenhancement process when the predetermined degree of hydroenhancement has been achieved.

5. A hydroenhancement system as defined in claim 4 wherein the hydroenhancement measuring unit includes a permeability testing arrangement disposed between the hydroenhancement means and the second spool.

6. A hydroenhancement system as defined in claim 4 wherein the hydroenhancement measuring unit includes a permeability testing arrangement disposed between the first spool and the hydroenhancement means.

7. A hydroenhancement system as defined in claim 4 wherein the hydroenhancement measuring unit includes a first permeability testing arrangement disposed between the first spool and the hydroenhancement means and a second permeability testing arrangement disposed between said hydroenhancement means and the second spool.

8. A hydroenhancement system as defined in claim 1 wherein the hydroenhancement means comprises at least one pressurized hydroenhancement jet configured to allow for a surface of the fabric to be exposed to a pressurized stream of liquid exiting from the jet to impart the hydroenhancement to the exposed area of the fabric.

9. A hydroenhancement system as defined in claim 8 wherein the system further comprises a process control means coupled to the hydroenhancement measuring unit, said process control means, in response to the measured degree of hydroenhancement, capable of adjusting one or more of the following process parameters on each pass through said system: the speed at which the fabric moves through the hydroenhancement means, the fabric tension created by the first and second spools, the identity of active hydroenhancement jets within the set of the at least one hydroenhancement jets, and the hydroenhancement energy, the hydroenhancement energy defined by the pressure of the liquid exiting said at least one hydroenhancement jet.

10. A hydroenhancement system as defined in claim 9 wherein the process control means provides manual adjustment of one or more of the process parameters.

11. A hydroenhancement system as defined in claim 9 wherein the process control means provides automatic adjustment of one or more of the process parameters.

12. A hydroenhancement system as defined in claim 8 wherein the hydroenhancement means further comprises a fabric support surface for supporting the fabric being subjected to hydroenhancement as it passes through the hydroenhancement means and disposed in relation to the at least one hydroenhancement jet such that sequential portions of the fabric surface are exposed to the pressurized stream of liquid exiting the at least one jet as the fabric moves through said hydroenhancement means.

13. A hydroenhancement system as defined in claim 9 wherein the hydroenhancement means further comprises a recirculating water system coupled between the fabric support surface and the at least one jet, said recirculating water system for capturing the liquid passing through the fabric during the hydroenhancement process, filtering the liquid and pressurizing the liquid as it re-enters the at least one hydroenhancement jet.

14. A hydroenhancement system as defined in claim 8 wherein the at least one hydroenhancement jet is held in a fixed position.

15. A hydroenhancement system as defined in claim 8 wherein the at least one hydroenhancement jet is in vibrational motion within the hydroenhancement means.

16. A hydroenhancement system as defined in claim 8 wherein the hydroenhancement means further comprises at least one vacuum roll disposed to allow for the fabric to pass over said at least one vacuum roll such that a portion of the fabric in contact with the roll is exposed to the pressurized stream from the associated hydroenhancement jet.

17. A hydroenhancement system as defined in claim 16 wherein the system further comprises a recirculating water system coupled between the at least one vacuum roll and the at least one hydroenhancement jet, said recirculating water system for capturing the liquid passing through the fabric during the hydroenhancement process, filtering the liquid and pressurizing the liquid as it re-enters the at least one hydroenhancement jet.

18. A hydroenhancement system as defined in claim 16 wherein the hydroenhancement means includes a single vacuum roll and a single associated pressurized hydroenhancement jet.

19. A hydroenhancement system as defined in claim 16 wherein the hydroenhancement means includes a first vacuum roll and associated first pressurized jet, and a second vacuum roll and associated second pressurized jet.

20. A hydroenhancement system as defined in claim 19 wherein the first and second vacuum rolls are disposed in a predetermined relationship such that a first side of the fabric (F) is exposed to the stream of liquid from the first jet and the second, opposite side of said fabric (B) is exposed to the stream of liquid from the second jet on each forward and reverse pass through the hydroenhancement means, effectively providing enhancement on alternate sides of said fabric in a sequence of FB-BF-FB-BF . . . , for as many passes as required through said hydroenhancement system.

21. A hydroenhancement system as defined in claim 19 wherein the hydroenhancement means further comprises a third vacuum roll and associated third pressurized jet.

22. A hydroenhancement system as defined in claim 21 wherein the first, second and third vacuum rolls are disposed sequentially and arranged such that a first side of the fabric (F) is exposed to the stream of liquid from the first or third jets, and the second, opposite side of said fabric (B) is exposed to the stream of liquid from the second jet, effectively providing enhancement on alternating side of said fabric in a sequence of FB-FB-FB-FB . . . , for as many passes as required through said hydroenhancement system.

23. A hydroenhancement system as defined in claim 8 wherein the hydroenhancement means includes a moving wire hydroenhancement system comprising a fabric conveying arrangement and at least one pressurized jet disposed above said conveying arrangement in a manner such that the stream of liquid exiting said at least one pressurized jet will impact the fabric.

24. A hydroenhancement system as defined in claim 23 wherein the system further comprises a recirculating water system coupled between the moving wire hydroenhancement system and the at least one jet, said recirculating water system for capturing the liquid passing through the fabric during the hydroenhancement process, filtering the liquid and pressurizing the liquid as it re-enters the at least on hydroenhancement jet.

25. A hydroenhancement system as defined in claim 1 wherein the system further comprises at least one additional treatment zone for providing additional fabric processing during the hydroenhancement process.

26. A hydroenhancement system as defined in claim 25 wherein at least one additional treatment zone is located between the hydroenhancement means and the second spool.

27. A hydroenhancement system as defined in claim 25 wherein at least one additional treatment zone is located between the first spool and the hydroenhancement means.

28. A hydroenhancement system as defined in claim 25 wherein the at least one additional treatment zone is disposed between a first hydroenhancement element and a second hydroenhancement element forming hydroenhancement means.

29. A hydroenhancement system as defined in claim 25 wherein each additional treatment zone may be individually controlled so as to be used at any predetermined time in the hydroenhancement process, including prior to the hydroenhancement process, simultaneously with the hydroenhancement process, and subsequent to the hydroenhancement process.

30. A method for imparting hydroenhancement to a fabric, the method comprising the steps of:

a) providing a fabric to be treated, said fabric being loaded onto a first tension-controlled spool;

b) passing said fabric through a hydroenhancement process;

c) imparting a predetermined limited amount of hydroenhancement to said fabric;

d) loading the fabric, after the hydroenhancement of step c), onto a second tension-controlled spool;

e) reversing the process so that the fabric is subjected to the process of step b) and reloaded onto the first spool of step a); and f) continuing the forward and reverse processes for any desired number of passes through the hydroenhancement process until a predetermined degree of hydroenhancement is achieved.

31. The method as defined in claim 30 wherein the process further includes the step of evaluating the hydroenhancement on each forward and reverse process.

32. The method as defined in claim 31 wherein the evaluation is performed by measuring the permeability of the fabric.

33. The method as defined in claim 30 wherein in performing step b), at least one pressurized hydroenhancement jet is used impart a stream of pressurized liquid onto the fabric surface to provide the hydroenhancement.

34. The method as defined in claim 33 wherein in performing step b), the at least one hydroenhancement jet is held in a fixed position.

35. The method as defined in claim 33 wherein in performing step b), the at least one hydroenhancement jet is vibrating.

36. The method as defined in claim 33 wherein the method comprises the further step of controlling one or more of the following process parameters: the speed at which the fabric passes under the at least one hydroenhancement jet, the fabric tension created by the first and second spools, the identity of active hydroenhancement jets, and the hydroenhancement energy, defined as the pressure at which the liquid exists the at least one hydroenhancement jet.

37. The method as defined in claim 36 wherein the controlling is performed manually.

38. The method as defined in claim 36 wherein the controlling is performed automatically.

39. The method as defined in claim 33 wherein in performing step b), a fabric support surface is used to pass the fabric underneath the at least one hydroenhancement jet so as to expose the fabric to the pressurized liquid stream exiting the at least one hydroenhancement jet.

40. The method as defined in claim 39 wherein the method comprises the further step of recirculating the water between the fabric support surface and the at least one hydroenhancement jet, the recirculating step including the steps of (i) filtering the liquid stream after it passes through the fabric to remove fibers; and (ii) re-pressurizing the stream as it enters the at least one hydroenhancement jet.

41. The method as defined in claim 33 wherein in performing step b), at least one vacuum roll is used in association, in a one to one relationship, with the at least one pressurized hydroenhancement jet.

42. The method as defined in claim 41 wherein the method comprises the further step of recirculating the water between the at least one vacuum roll and the at least one hydroenhancement jet, the recirculating step including the steps of (i) filtering the liquid stream after exiting the at least one vacuum roll to remove fibers; and (ii) re-pressurizing the stream as it enters the at least one hydroenhancement jet.

43. The method as defined in claim 41 wherein a single vacuum roll and a single pressurized hydroenhancement jet are used.

44. The method as defined in claim 41 wherein in performing step b), a pair of vacuum rolls and an associated pair of hydroenhancement jets are used, the pair of vacuum rolls disposed to that a first side of the fabric is treated by a first jet of said pair of jets and a second side of the fabric is treated by a second jet of said pair of jets.

45. The method as defined in claim 41 wherein in performing step b), a set of three vacuum rolls and an associated set of three hydroenhancement jets are used, the set of vacuum rolls disposed sequentially such that a first side (F) of the fabric is treated by a first jet and/or a third jet of the set of three jets, and a second, opposite side (B) of the fabric is treated by the remaining, second jet of said set of three jets.

46. The method as defined in claim 41 wherein the individual jets are controlled to be "on" or "off" on each forward and reverse pass through the system, to obtain any predefined combination.

47. The method as defined in claim 33 wherein in performing step b), a moving wire hydroenhancement system is positioned underneath the at least one hydroenhancement jet to expose the fabric to the pressurized stream exiting said at least one hydroenhancement jet.

48. The method as defined in claim 47 wherein the method comprises the further step of recirculating the water between the moving wire system and the at least one hydroenhancement jet, the recirculating step including the steps of (i) filtering the liquid stream after it passes through the fabric to remove fibers; and (ii) re-pressurizing the stream as it enters the at least one hydroenhancement jet.

49. The method as defined in claim 30 wherein the method comprises the additional step of performing one or more additional fabric treatment processes.

50. The method as defined in claim 49 wherein at least one additional fabric treatment process is performed prior to performing step d).

51. The method as defined in claim 50 wherein the additional treatment includes any one of the following processes: acid bath, dying, scouring, washing and bleaching.

52. The method as defined in claim 49 wherein at least one additional fabric treatment process is a pretreatment process performed prior to step b).

53. The method as defined in claim 52 wherein the pretreatment process includes a non-liquid emersion treatment using any one of the following systems: UV treatment, atomizing, and oxidizing.

54. The method as defined in claim 30 wherein the method comprises the additional step of monitoring the fabric tension on each pass through the system.

55. The method as defined in claim 54 wherein the fabric tension is monitored and may be readjusted on each pass to remain essentially constant during the hydroenhancement process.

56. The method as defined in claim 54 wherein the fabric tension is monitored and may be readjusted on each pass to either increase or decrease the fabric tension to produce a desired effect in the fabric.

* * * * *